US008083106B2

(12) United States Patent
Park et al.

(10) Patent No.: US 8,083,106 B2
(45) Date of Patent: Dec. 27, 2011

(54) REFRIGERATOR

(75) Inventors: Kyong Bae Park, Seoul (KR); Nam Soo Cho, Seoul (KR); Dong Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 871 days.

(21) Appl. No.: 11/808,265

(22) Filed: Jun. 7, 2007

(65) Prior Publication Data

US 2008/0061088 A1 Mar. 13, 2008

(30) Foreign Application Priority Data

Sep. 8, 2006 (KR) ..... 10-2006-0086841

(51) Int. Cl.
*B65D 47/00* (2006.01)

(52) U.S. Cl. ..... 222/477

(58) Field of Classification Search ..... 222/477, 222/108, 556; 221/16, 15; 62/344; 188/82.8, 188/82.84; 251/64; 16/49, 65
See application file for complete search history.

(56) References Cited

U.S. PATENT DOCUMENTS

| | | | | | |
|---|---|---|---|---|---|
| 2,122,162 | A | * | 6/1938 | Smith | 16/49 |
| 2,472,508 | A | * | 6/1949 | Allen | 16/65 |
| 2,836,844 | A | * | 6/1958 | May | 16/65 |
| 3,537,132 | A | * | 11/1970 | Alvarez | 62/266 |
| 3,942,334 | A | * | 3/1976 | Pink | 62/266 |
| 4,090,641 | A | * | 5/1978 | Lindenschmidt | 222/504 |
| 4,220,266 | A | * | 9/1980 | Braden et al. | 222/477 |
| 4,462,437 | A | * | 7/1984 | Prada | 141/360 |
| 4,639,969 | A | * | 2/1987 | Obenshain | 16/70 |
| 6,135,173 | A | * | 10/2000 | Lee et al. | 141/361 |

* cited by examiner

*Primary Examiner* — Kevin P Shaver
*Assistant Examiner* — Daniel R Shearer
(74) *Attorney, Agent, or Firm* — KED & Associates LLP

(57) ABSTRACT

A refrigerator includes an ice dispenser with a duct cap for opening and closing an ice duct of the dispenser. A user operated lever is operably coupled to both the duct cap, and a joint member. A frictional member is disposed to come in frictional contact with the joint member as the duct cap moves between open and closed position. An elastic member elastically supports the joint member with respect to the lever. The closing operation of the duct cap is delayed by using a frictional force developed between the joint member and the frictional member.

4 Claims, 7 Drawing Sheets

REFRIGERATOR

This application claims priority under 35 U.S.C. §119(a) to Korean Patent Application No. 10-2006-0086841, filed on Sep. 8, 2006, the entire contents of which are hereby incorporated by reference.

BACKGROUND

1. Field

The present invention relates to a refrigerator having an ice dispenser, and more specifically, to an ice dispenser having a friction-type time delay mechanism to delay a closing operation of an ice duct of the dispenser.

2. Background

In general, refrigerators serve to maintain a freezer compartment and/or a refrigerator compartment at low temperatures. Typically, the refrigerator uses a freezing cycle apparatus including a compressor, a condenser, an expander, and an evaporator. FIG. 1 is a perspective view of a typical refrigerator, where the freezer and refrigerator chambers are opened. As shown in FIG. 1, the refrigerator includes a main body 2 having a freezer chamber F and a refrigerator chamber R, divided by a barrier 1. A freezing cycle apparatus keeps the freezer chamber F and the refrigerator chamber R at low temperatures. A freezer door 4 is connected to the main body 2 so as to open and close the freezer chamber F; and a refrigerator door 6 is connected to the main body 2 so as to open and close the refrigerator chamber R.

The freezing cycle apparatus includes a compressor that compresses a low-temperature and low-pressure gas refrigerant. The freezing cycle apparatus also includes a condenser in which the high-temperature and high-pressure refrigerant compressed by the compressor is circulated so that heat radiates into external air such that the refrigerant is condensed. An expander decompresses the refrigerant condensed by the condenser. An evaporator, in which the refrigerant is expanded by the expander, absorbs the heat of air circulating in the freezer chamber F and/or the refrigerator chamber R so as to be evaporated.

Recently, refrigerators have been equipped with automatic ice making machines. The automatic ice making machine makes ice by using cool air within the freezer chamber F. The ice is then discharged to the outside in accordance with a manipulation of a user.

The automatic ice making machine includes an ice maker 8 which makes water into ice by using cool air within the freezer chamber F. An ice bank 9 stores the ice made by the ice maker 8. The ice bank 9 includes a transferring unit which transfers ice in the ice bank 9 such that the ice is discharged from the ice bank. A motor 10 operates the transferring unit.

The freezer door 4 has a dispenser (not shown) installed therein which supplies the ice transferred from the ice bank 9 and possibly also water fed from a water feeder (not shown). The freezer door 4 includes an ice duct 12 serving as a path which guides the ice transferred from the ice bank 9 to the dispenser. An ice duct opening and closing mechanism 13 opens and closes the ice duct 12.

FIG. 2 is a perspective view illustrating the ice duct opening and closing mechanism of the refrigerator shown in FIG. 1. FIG. 3 is a control block diagram of the automatic ice making machine shown in FIG. 1.

The ice duct opening and closing mechanism 13 shown in FIG. 2 includes a duct cap 21 disposed to open and close the ice duct 12. A lever 22 can be manipulated by a user to open and close the ice duct. A micro switch 23 is turned on/off by the lever 22. A rotating shaft 24 is disposed to rotate the duct cap 21. A solenoid 25 is installed to rotate the rotating shaft 24 such that the duct cap 21 can be rotated between open and closed positions. A spring 26 is installed to bias the rotating shaft 24 such that the duct cap 21 tends to rotate to the closed position.

The refrigerator further includes a controller 30 which operates the motor 10 of the ice bank 9 and the solenoid 25 in accordance with an input of the micro switch 23.

When a user presses the lever 22, that is, when a force is applied to the lever 22, the lever 22 operates the microswitch 23. Based on a signal from the microswitch, the controller 30 operates the solenoid 25 and the motor 10 of the ice bank 9. The solenoid 25 rotates the rotating shaft 24 and the duct cap 21, thereby opening the ice duct 12. When the motor 10 of the ice bank 9 is operated, ice is discharged from the ice bank 9 so as to fall into the ice duct 12. Further, the ice is discharged from the dispenser through the opened ice duct 12.

When the user releases the lever 22, that is, when the force applied to the lever 22 is removed, the lever 22 turns off the micro switch 23. In response, the controller 30 does not immediately remove the signal to the solenoid 25. Instead, the controller will wait for a predetermined period of time (for example, four seconds) to elapse to allow discharged ice to fall through the ice duct. Then, after the delay period has expired, the signal is removed from the solenoid. When the signal is removed from the solenoid, the spring 26 rotates the rotating shaft 24, and the duct cap 21 so as to close the ice duct 12.

The use of the solenoid 25 increases the cost of the refrigerator. In addition, noise occurs when the solenoid 25 is operated.

BRIEF DESCRIPTION OF THE DRAWINGS

The embodiments will be described in detail with reference to the following drawings in which like reference numerals refer to like elements, and wherein.

DETAILED DESCRIPTION

Figure 1:
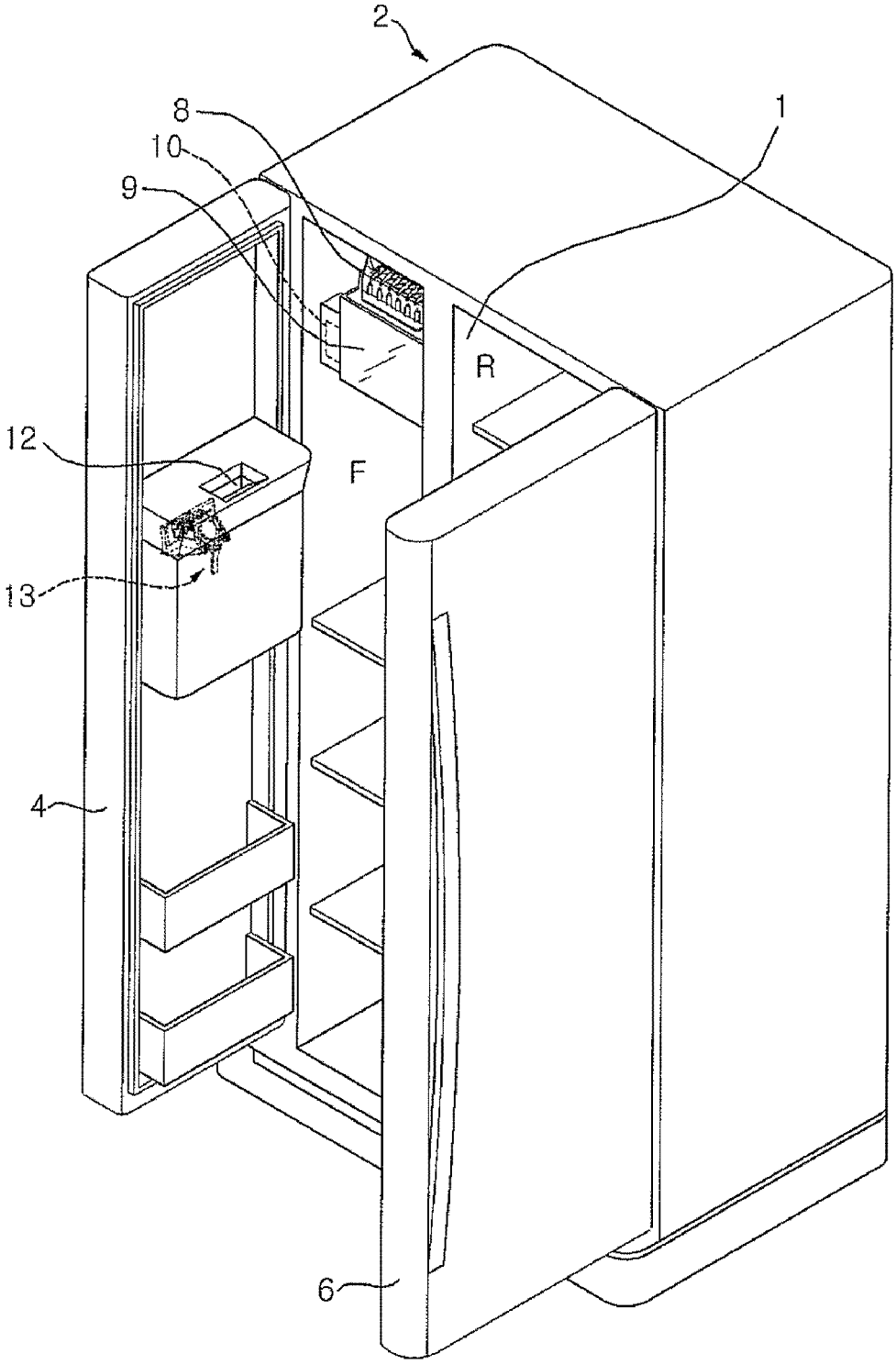
FIG. 1 (PRIOR ART)
FIG. 1 is a perspective view of a related art refrigerator, showing a state where the freezer chamber and the refrigerator chamber thereof are opened.
Figure 2:
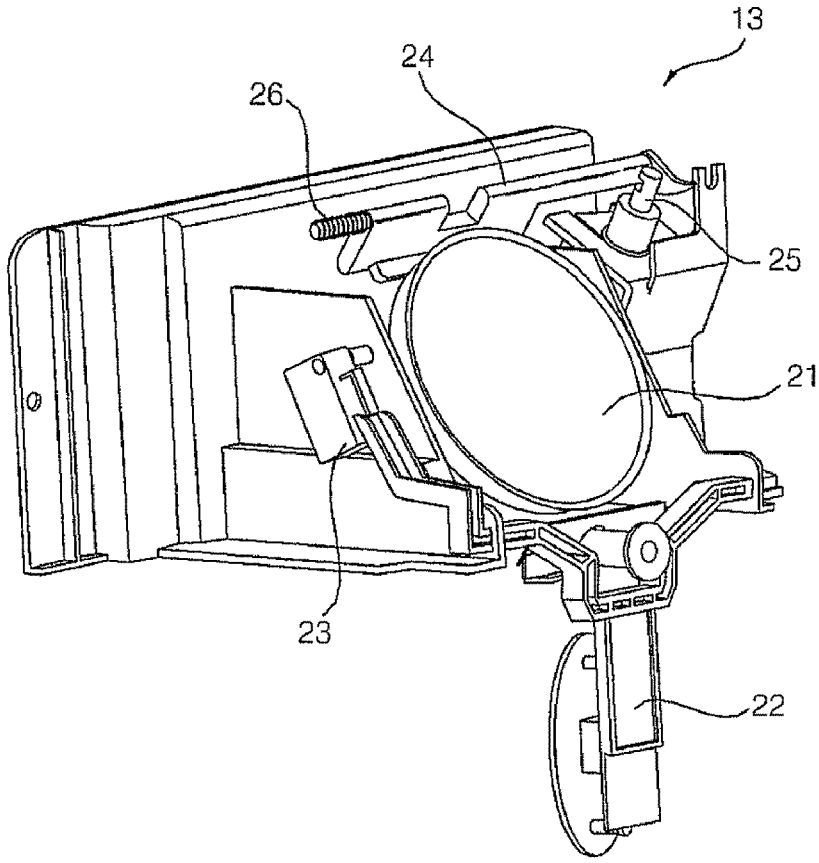
FIG. 2 (PRIOR ART)
FIG. 2 is a perspective view illustrating an ice duct opening and closing mechanism of the refrigerator shown in FIG. 1.
Figure 3:
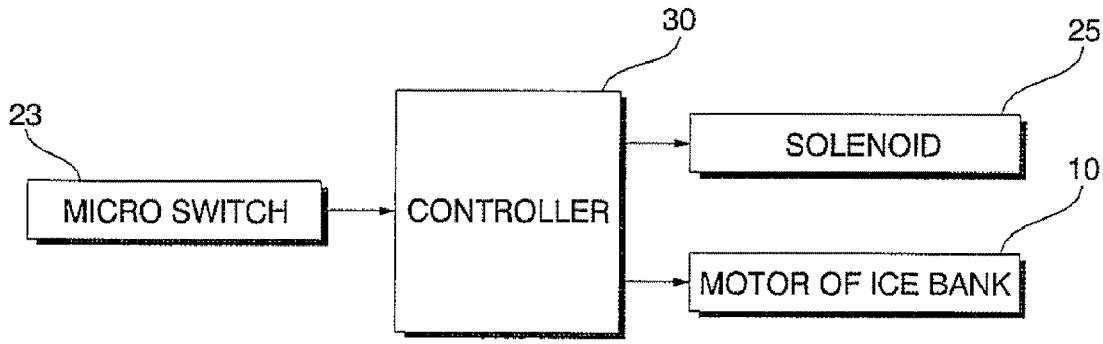
FIG. 3 (PRIOR ART)
FIG. 3 is a block diagram of elements of an ice dispenser of the refrigerator shown in FIG. 1.
Figure 4:
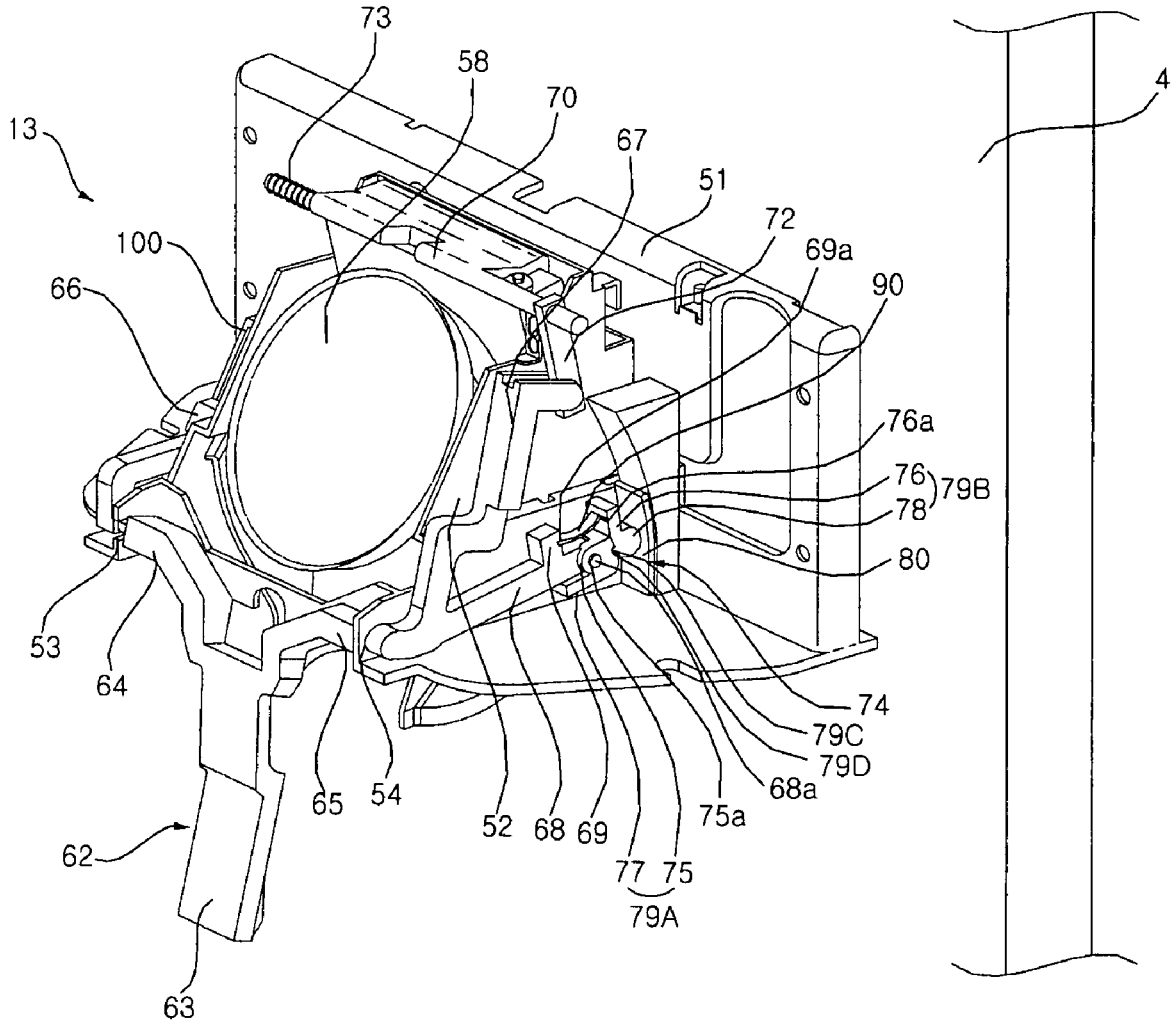
FIG. 4 is a perspective view illustrating an ice duct opening and closing mechanism of a first embodiment.

A refrigerator according to a first embodiment includes an ice duct closing and opening mechanism 13 which opens and closes an ice duct 12 in accordance with a manipulation of a user. As shown in FIG. 4, the ice duct opening and closing mechanism 13 includes a funnel 51 which is fastened to a freezer door 4 by a fastening member such as a screw or the like. The funnel 51 rotatably supports a lever 62 and a rotating shaft 70 of an opening and closing mechanism 60 to be described below. Further, the funnel 51 prevents a piece of ice passing through the ice duct 12 from spattering into the side or the front side of the dispenser. Under the ice duct 12, a duct portion 52 is formed so as to communicate with the lower portion of the ice duct 12.

The funnel 51 has a micro switch 100 installed thereon, the micro switch 100 being switched by the lever 62 of the opening and closing mechanism 60. Preferably, the micro switch 100 is installed near the duct portion 52.

The ice duct opening and closing mechanism 13 includes a duct cap 58 which actually opens and closes the ice duct 12. An opening and closing mechanism 60 moves the duct cap 58 between open and closed positions. A friction-type time delay mechanism delays a closing operation of the duct cap 58 by using a frictional force when the closing operation of the duct cap 58 is performed.

The duct cap 58 can be slidably and/or rotatably disposed under the ice duct 12. The following descriptions will be focus on a case where the duct cap 58 is rotatably disposed so as to open and close the ice duct 12 in a rotational manner. However, in alternative embodiments, the duct cap could slide between the open and closed positions.

In this embodiment, the duct cap 58 is mounted such that it can rotate back and forth with respect to an upper portion thereof. Further, the duct cap 58 is inserted into the duct portion 52 of the funnel 51 so as to make the duct portion 52 of the funnel 51 communicate with the ice duct 12.

The opening and closing mechanism 60 serves to manually open and close the duct cap 58. The opening and closing mechanism 60 includes a lever 62 which can be manipulated by a user. A rotating shaft 70 is mechanically connected to the lever 62 so as to rotate the duct cap 58. A spring 73 biases at least one of the lever 62 and the rotating shaft 70 such that the duct cap 58 tends to rotate to the closed position. One side of the spring 73 is connected to the funnel 51, and the other side thereof is connected to the rotating shaft 70. The spring 73 can be a coil spring, a torsion spring, or some other type of biasing member.

The lever 62 includes a vertical bar 63 which is positioned in an inner space of the dispenser so as to be pressed backward by a user. Left and right horizontal bars 64 and 65 extend from the upper end of the vertical bar 63 in opposite directions and they are rotatably supported by lever supporting portions 53 and 54 formed at the left and right sides of the rear end of the duct portion 52. A switch connection bar 66 extends from one of the left and right horizontal bars 64 and 65 so as to turn on/off the micro switch 90. A rotating shaft connection bar 67 extends from the other of the left and right horizontal bars 64 and 65 so as to be connected to the rotating shaft 70.

The rotating shaft 70 is mounted on an upper part of the duct portion 52 of the funnel 51 and is rotatably supported by a shaft supporting portion. One end of the rotating shaft 70 has a connection portion 72 formed to project thereon. The connection portion 72 is rotatably connected to the rotating shaft connection bar 67 of the lever 62 through a hinge or pin.

The lever 62 is also connected to a joint member connection bar 68. A joint member 74 is rotatably connected to an opposite end of the joint member connection bar 68. The joint member connection bar 68 is configured to trace a path along a face of a frictional member 80 as the duct cap 58 moves between the open and closed positions.

The joint member connection bar 68 has an elastic member fixing portion 69 into which a first end of an elastic member 90 is inserted and fixed. The elastic member fixing portion 69 of the joint member connection bar 68 has an elastic member insertion groove 69*a* into which the first end of the elastic member 90 is inserted.

Figure 8:
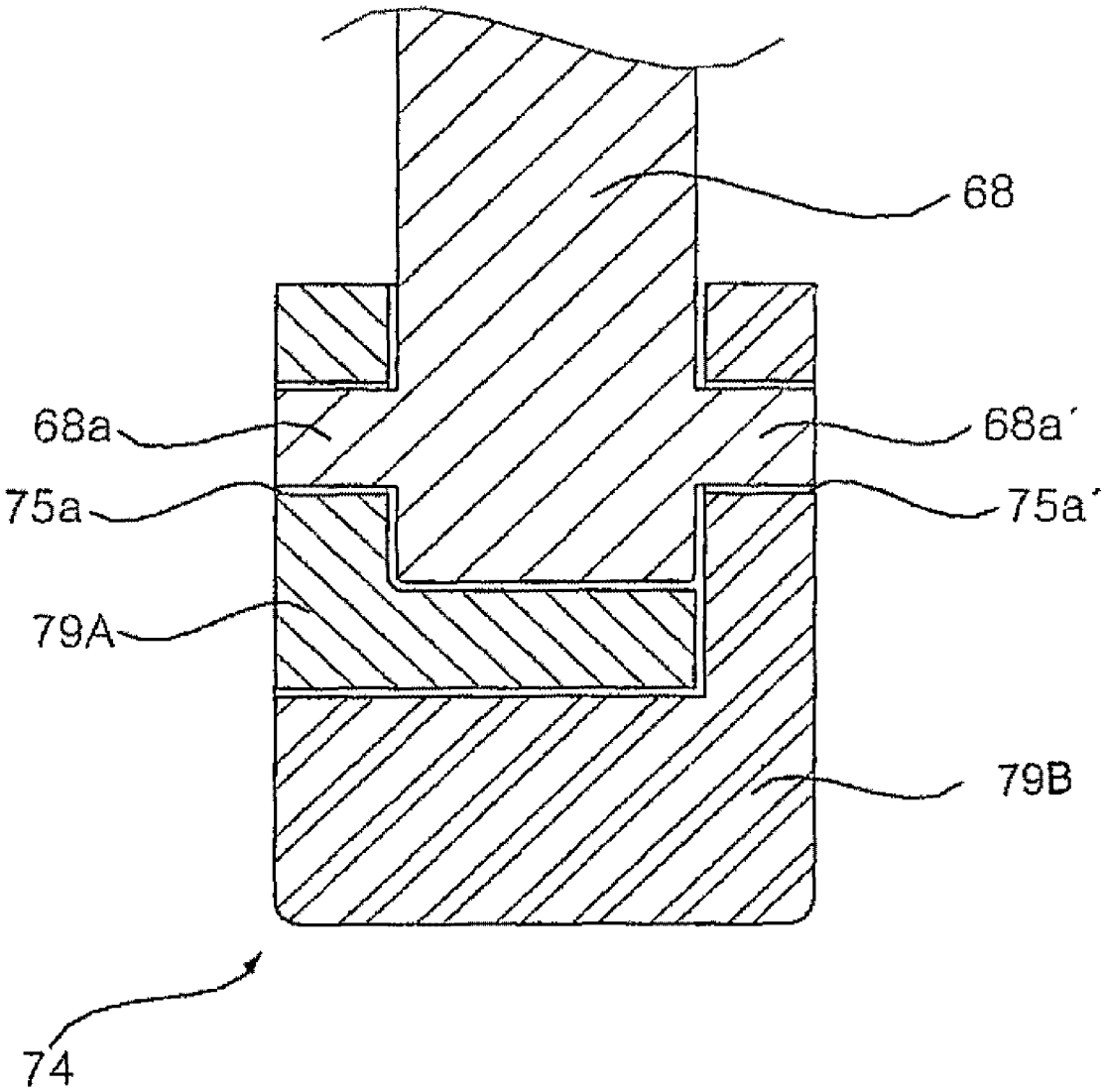
FIG. 8 is an enlarged sectional view of a joint member and a joint member connecting bar of the mechanism shown in FIGS. 4 to 7.

The joint member 74 is connected to the joint member connection bar 68 by a rotational connection portion 75. This allows the joint member 74 to rotate around the end of the joint member connection bar 68. As shown in FIG. 8, the joint member connection bar 68 includes hinge pins 68*a* and 68*a*', and the rotational connection portion 75 of the joint member 74 has hinge holes 75*a* and 75*a*' into which the hinge pins 68*a* and 68*a*' are inserted.

The joint member 74 also has an elastic member fixing portion 76 into which the second end of the elastic member 90 is inserted and fixed. The elastic member fixing portion 76 of the joint member 74 is formed to project from the joint member 74 so as to face the elastic member fixing portion 69 of the joint member connection bar 68. The elastic member fixing portion 76 of the joint member 74 has an elastic member insertion groove 76*a* into which the second end of the elastic member 90 is inserted.

The joint member 74 also has a locking portion 77 which extends from the bottom of the joint member 74, and which is configured to contact the joint member connection bar 68 to limit rotation of the joint member 74 in one direction. This configuration allows the joint member 74 to rotate in first direction relative to the joint member connection bar 68 such that the elastic member can be compressed. But the joint member is prevented from rotating more than a certain amount in the opposite direction by the locking portion 77. Preferably, the locking portion 77 is formed in a plate shape or protrusion shape so as to be locked to the joint member connection bar 68.

The joint member 74 has a friction portion 78 composed of a curved portion projecting from the joint member 74.

In some embodiments, the rotational connection portion 75, the elastic member fixing portion 76, the locking portion 77, and the frictional portion 78 can be formed together as a unitary member. However, in other embodiments two or more members can be combined to form the joint member 74. The following descriptions will be focused on a case where the joint member 74 is composed of two members.

As shown in FIG. 8, the joint member 74 is composed of a first joint member 79A and a second joint member 79B. The first joint member 79A has a hinge hole 75*a* by which one hinge pin 68*a* of the joint member connection bar 68 is rotatably supported. The second joint member 79B is coupled to the first joint member 79A and has a hinge hole 75*a*' in which the other hinge pin 68*a*' of the joint member connection bar 68 is rotatably supported.

One of the first and second joint members 79A and 79B has a protrusion 79C formed for the coupling the first and second joint members together. The other has a protrusion insertion groove 79D into which the protrusion 79C is inserted.

In this embodiment, the first joint member 79A has the locking portion 77. The second joint member 79B has the frictional portion 78, which has a convex shape that projects toward the frictional member 80.

The frictional member 80 is formed in a curved shape such that the frictional portion 78 of the joint member 74 comes in frictional contact with the frictional member 80 and simultaneously slides on the frictional member 80, when the lever 62 is rotated. If the frictional member 80 is made longer, the closing delay time of the duct cap 58 is lengthened. Also, as the friction coefficient of the frictional surface is made greater, the closing delay time of the duct cap 58 is lengthened. Preferably, the frictional member 80 is formed of an elastic member such that when the joint member 74 comes in contact with the frictional member 80, the impact threrebetween is reduced.

The elastic member 90 serves to press the joint member 74 so that it extends from the end of the joint member connection bar 68. The elastic member 90 can be a plate spring, a coil spring or some other type of biasing member.

Figure 6:
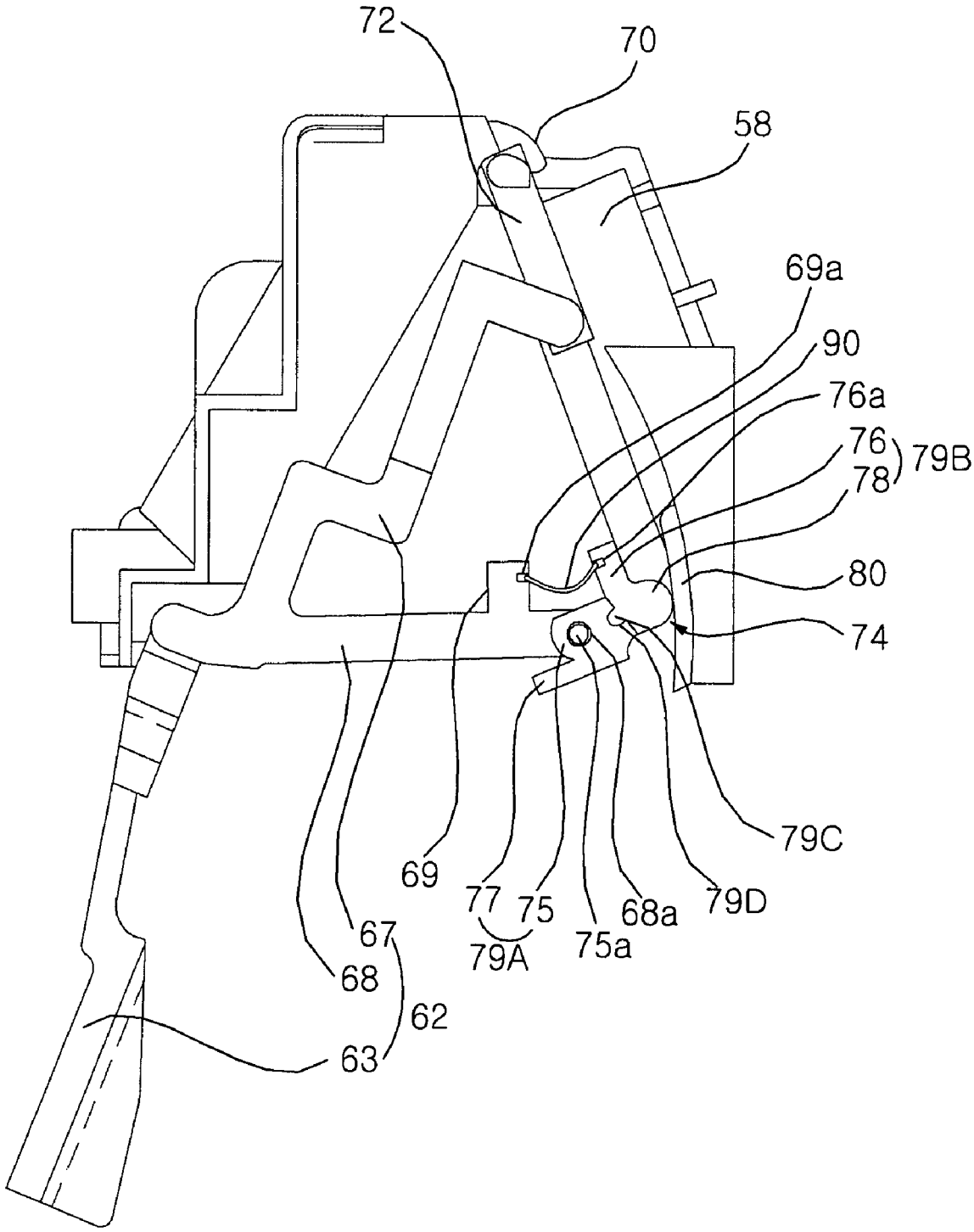
FIG. 6 is a side view of the mechanism shown in FIG. 4 in a open position.

When a user presses the vertical bar 63 of the lever 62 from the state shown in FIG. 4 to the state shown in FIG. 6, the lever 62 and the horizontal bars 64 and 65 rotate. As a result, the shaft connection bar 67 rotates the rotating shaft 70. The rotating shaft 70 deforms the spring 73 and simultaneously rotates the duct cap 58 so that the duct cap 58 starts to open the ice duct 12.

In addition, as the lever 62 is rotated, the joint member 74 at the end of the joint member connection bar 68 is moved downward so that the frictional portion 78 comes in contact with the frictional member 80. Contact between the frictional portion 78 and the frictional member 80 causes the joint member 74 to rotate upward relative to the joint member connection bar 68, thereby compressing the elastic member 90. Because the upward rotation of the joint member 74 is only impeded by the elastic member 90 as the duct cap moves to the open position, the duct cap 58 moves relatively quickly to open the ice duct 12.

When the lever 62 is rotated to open the duct, the switch connection bar 66 of the lever 62 turns on the micro switch 100. When the controller 30 receives a signal of the micro switch 100, it turns on the motor 10 of the ice bank 9. When the motor 10 of the ice bank 9 is operated, ice put in the ice bank 9 is discharged from the ice bank 9 so as to fall into the ice duct 12. The ice passes through the opened ice duct 12 and the ice discharge portion 52 of the funnel 51 so as to be discharged from the dispenser 11.

When the user releases the lever 62, that is, the force applied to the lever 62 is removed, the spring 73 acts to move the duct cap back towards the closed position. The rotating shaft 70 begins to rotate in the reverse direction. As the rotating shaft 70 begins to reverse rotate, the switch connection bar 66 of the lever 62 turns off the micro switch 100, and the controller 30 stops the motor 10 of the ice bank 9. Thus, ice is no longer discharged from the ice bank 9.

Figure 7:
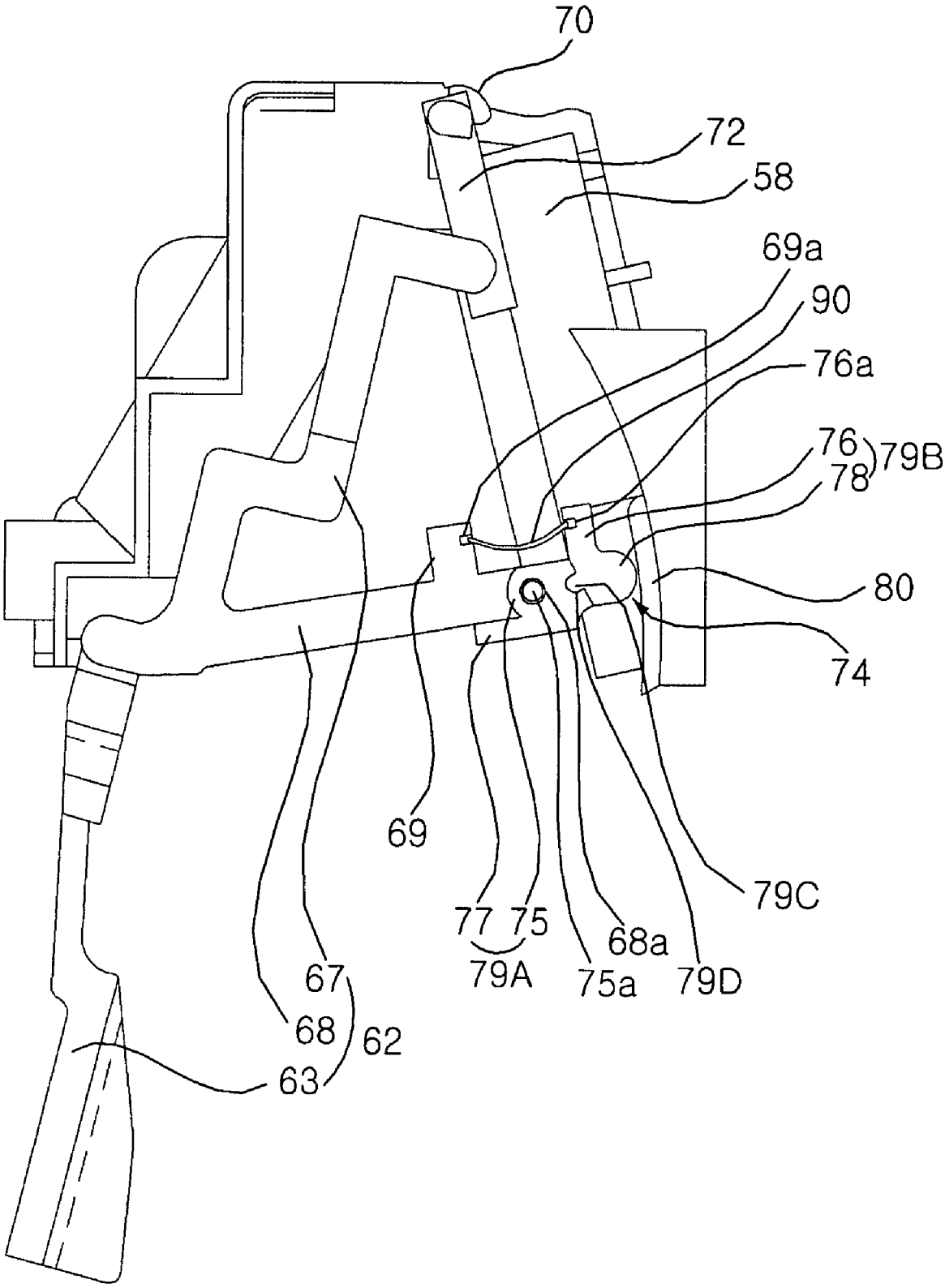
FIG. 7 is a side view of the mechanism shown in FIG. 4 as the mechanism is closing.

The reverse rotation also causes the joint member connection bar 68 to begin to move upward. At this time, the elastic member 90 continues to push the joint member 74 against the friction member 80. As the joint member connection bar 68 moves upward, the joint member 74 first reverse rotates until the locking portion 77 contacts the bottom of the joint member connection bar 68, as shown in FIG. 7. As the joint member connection bar 68 continues to move upward, the frictional portion 78 of the joint member 74 then slowly slides along the frictional member 80. The spring 73 acts to try to move the joint member connection bar 68 and the attached joint member 74 upward. The frictional force resulting from friction between the friction portion 78 and the frictional member 80 acts to impede upward motion of the joint member connection bar 68. As a result, the lever 62 and the rotating shaft 70 are slowly rotated such that the ice duct 12 is slowly closed. While the ice duct 12 is slowly closed, remaining ice discharged from the ice bank 9 falls from the dispenser.

Figure 5:
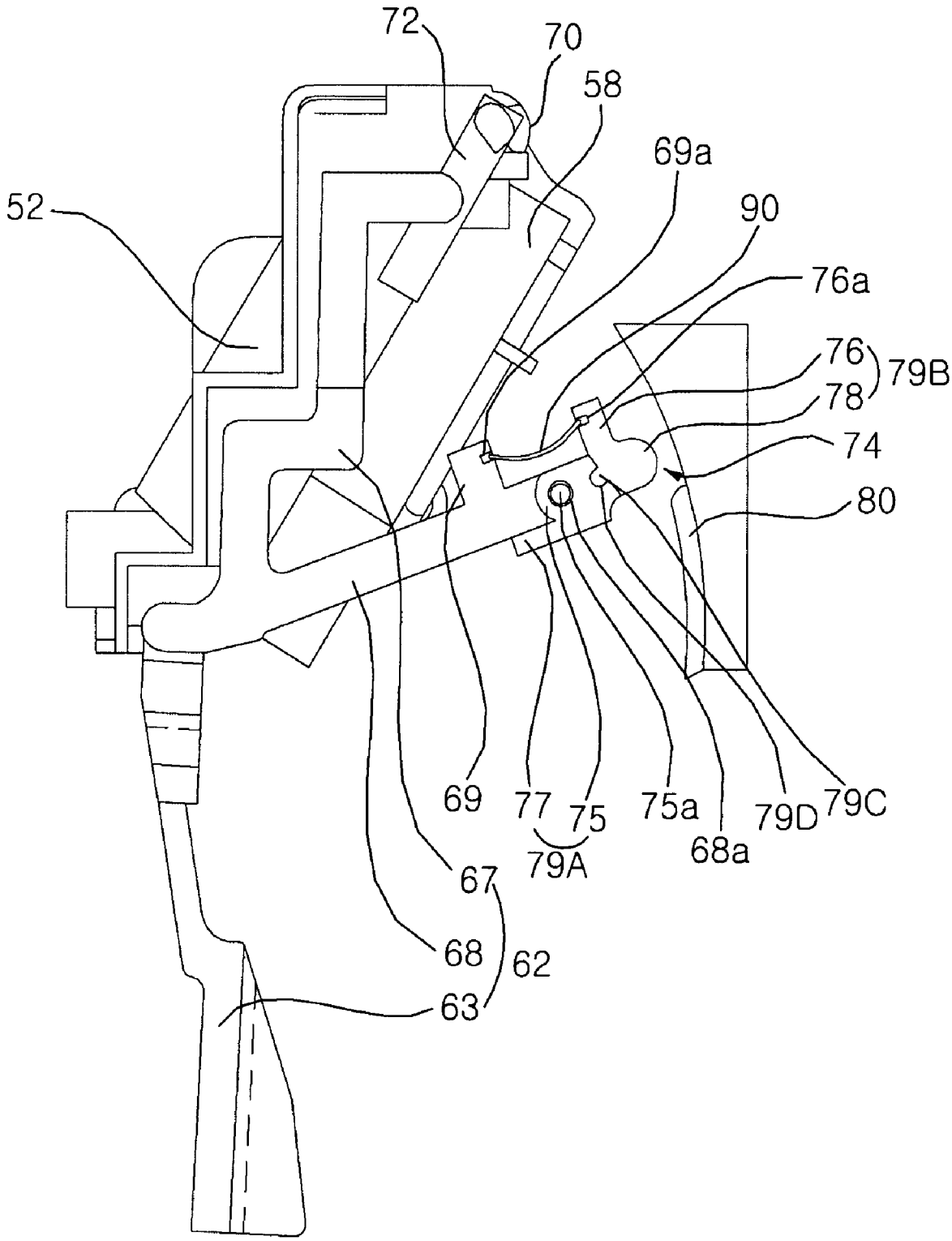
FIG. 5 is a side view of the mechanism shown in FIG. 4 in a closed position.

After a predetermined time passes, the joint member 74 loses contact with the frictional member 80, as shown in FIG. 5. As soon as the joint member 74 breaks contact with the frictional member 80, the frictional force disappears and the restoring force of the spring 73 acts to quickly rotate the shaft 70 and the duct cap 58 to quickly closes the ice duct 12.

The frictional member 80, the joint member connection bar 68, the joint member 74, and the elastic member 90 serve as a type of time delay mechanism which allows the duct cap 58 to quickly open, but which delays the closing operation of the duct cap 58 for a predetermined period of time. After the delay period expires, the remainder of the closing operation can be quickly performed.

The present invention is not limited to the above-described embodiment. That is, the ice maker 8 or the ice bank 9 can be installed in the rear surface of the freezer door 4. Further, various changes and modifications in form and detail may be made therein without departing from the scope of the present disclosure.

In a refrigerator as described above, the lever is directly connected to the rotating shaft which rotates the duct cap, and the friction-type time delay mechanism. The delay mechanism is composed of the joint member, the frictional member, and the elastic member. The delay mechanism can delay the closing of the duct cap using a frictional force. Therefore, it is possible to minimize a cost and noise, compared with ice dispensing mechanisms that use a solenoid as an electronic time delay mechanism.

In addition, because the lever includes the rotating connection bar, which is rotatably connected to the rotating shaft, and the joint member connection bar, both the rotating shaft and the joint member can be connected by one lever. Therefore, the structure thereof is simplified, and the number of parts is minimized.

The locking portion formed on the joint member is locked to the lever so as to prevent the joint member from being excessively rotated. Therefore, it is possible to prevent the malfunctioning of the time delay mechanism which can be caused when the joint member is excessively rotated.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although several embodiments have been described, it should be understood that numerous other modifications and embodiments can be devised by those skilled in the art that will fall within the spirit and scope of the principles of this disclosure. More particularly, various variations and modifications are possible in the component parts and/or arrangements of the subject combinations and still fall within the scope of the disclosure, the drawings and the appended claims. In addition to variations and modifications in the component parts and/or arrangements, alternative uses will also be apparent to those skilled in the art.

What is claimed is:

1. A refrigerator including an ice dispenser, comprising:

a duct cap that is movable between open and closed positions to open and close an ice duct formed in the refrigerator;

a lever that is operably coupled to the duct cap to move the duct cap between the closed and open positions;

a joint member that is operably coupled to the duct cap such that the joint member moves as the duct cap moves;

a joint member connection bar coupled to the joint member, wherein the joint member is rotatably coupled to an end of the joint member connection bar;

a frictional member disposed to come in frictional contact with the joint member as the joint member moves, wherein friction developed between the frictional member and the joint member acts to delay a closing operation of the duct cap; and an elastic member coupled between the joint member connection bar and the joint member, wherein the elastic member biases the joint member in a first rotational direction which causes the joint member to extend away from the end of the joint member connection bar, and wherein when the duct cap is moving from the closed to the open position, contact between the joint member and the frictional member causes the joint member to rotate in a second rotation direction, thereby compressing the elastic member, wherein the refrigerator further comprises:

a rotating shaft, wherein the duct cap is attached to the rotating shaft such that rotation of the shaft moves the duct cap between the open and closed positions; and a shaft connection bar that is coupled between the lever and the rotating shaft.

2. The refrigerator of claim 1, further comprising a biasing member that is operably coupled to the duct cap and that biases the duct cap toward the closed position.

3. The refrigerator of claim 1, wherein the frictional member has a concave frictional face, and wherein a convex frictional portion of the joint member contacts the frictional face of the frictional member.

4. A refrigerator including an ice dispenser, comprising:

a duct cap that is movable between open and closed positions to open and close an ice duct fowled in the refrigerator;

a lever that is operably coupled to the duct cap to move the duct cap between the closed and open positions;

a joint member that is operably coupled to the duct cap such that the joint member moves as the duct cap moves;

a joint member connection bar coupled to the joint member, wherein the joint member is rotatably coupled to an end of the joint member connection bar;

a frictional member disposed to come in frictional contact with the joint member as the joint member moves, wherein friction developed between the frictional member and the joint member acts to delay a closing operation of the duct cap; and an elastic member coupled between the joint member connection bar and the joint member, wherein the elastic member biases the joint member in a first rotational direction which causes the joint member to extend away from the end of the joint member connection bar, wherein when the duct cap is moving from the closed to the open position, contact between the joint member and the frictional member causes the joint member to rotate in a second rotation direction, thereby compressing the elastic member, and wherein the frictional member is formed of an elastic material.

* * * * *